US005462285A

United States Patent [19]

O'Patka et al.

[11] Patent Number: 5,462,285

[45] Date of Patent: Oct. 31, 1995

[54] GAME WITH ANIMATED CHARACTER

[76] Inventors: Dennis J. O'Patka, 4742 N. Kenmore Ave., Chicago, Ill. 60604; Craig C. Williamson, 8113 W. 26th St., North Riverside, Ill. 60546; Burton C. Meyer, 9S641 Main St., Downers Grove, Ill. 60516; John R. Wildman, 9545 N. Harding, Evanston, Ill. 60203

[21] Appl. No.: 337,183

[22] Filed: Nov. 7, 1994

[51] Int. Cl.[6] ..... A63H 33/18

[52] U.S. Cl. ..... 273/459; 124/16

[58] Field of Search ..... 273/317, 359, 273/459; 124/16, 26

[56] References Cited

U.S. PATENT DOCUMENTS

| | | | |
|---|---|---|---|
| 2,664,077 | 12/1953 | Moore | 124/16 |
| 3,618,583 | 11/1971 | Pottern | 124/16 |
| 3,851,418 | 12/1974 | Barlow et al. . | |
| 4,182,076 | 1/1980 | Gay et al. . | |
| 4,185,413 | 1/1980 | Goldfarb et al. . | |
| 4,246,722 | 1/1981 | Sapkus et al. . | |
| 4,516,951 | 5/1985 | Saigo et al. | 446/338 |
| 4,576,585 | 3/1986 | Balogh et al. | 446/199 |
| 4,662,855 | 5/1987 | Morrison | 446/227 |

*Primary Examiner*—William H. Grieb
*Attorney, Agent, or Firm*—Fish & Richardson

[57] ABSTRACT

A game includes a manual actuator, an animated character that is animated by actuation of the manual actuator, and a random integer generator such as a spinner. The animated character includes an ejector, an object such as a ball positioned in the ejector, a mechanical counter that is incremented by actuation of the manual actuator, and a release mechanism responsive to the mechanical counter to activate the ejector and thereby cause the ejector to eject the object when the counter is incremented to a sufficient number. A player of the game generates a random integer by spinning the spinner and actuates the manual actuator a number of times corresponding to the random integer.

20 Claims, 5 Drawing Sheets

GAME WITH ANIMATED CHARACTER

The invention relates generally to games, and, in particular, to a game that includes an animated character.

In general, the invention features a game that includes a manual actuator, an animated character that is animated by actuation of the manual actuator, and a random integer generator such as a spinner or a multi-sided die. A player of the game generates a random integer with the random integer generator and actuates the manual actuator a number of times corresponding to the random integer. If actuation of the manual actuator causes an object to be ejected from the animated character, the player is awarded a token. Once a player obtains a predetermined number of tokens, the player is declared the winner.

The animated character of the game includes an ejector, an object, such as a foam ball, positioned in the ejector, a mechanical counter that is incremented by actuation of the manual actuator, and a release mechanism that responds to the mechanical counter by activating the ejector and causing the ejector to eject the ball when the counter is incremented to a sufficient number.

Specific embodiments of the invention include one or more of the following features. Typically, the actuator is a plunger mounted on a common base with the character, and the character includes moving arms that change positions when the plunger is depressed. In addition to incrementing the counter and moving the arms, depressing the plunger also serves to compress the spring.

The character may also include a spring coupled to the ejector so that the release mechanism is a latch that normally maintains the spring in a compressed state and releases the spring when the mechanical counter reaches a sufficient number. The ejector may be a cylinder and piston that release of the spring causes to generate pressurized air that ejects the ball.

The mechanical counter may be implemented with a gearing system coupled between the manual actuator and the ejector. In this case, the latch may include a first gear that is coupled to the gearing system and interacts with a second gear attached to the ejector to maintain the spring in a compressed state, with the first gear having a toothless portion that releases the second gear and thereby releases the spring when the toothless portion is exposed to the second gear. Thus, in this case, the number of actuations that will cause the ball to be ejected is the number of actuations necessary to expose the toothless portion of the first gear to the second gear. Typically, the first gear is a pinion gear, and the second gear is a rack gear.

When the gear system is employed, the ejector can include a movable cylinder and a fixed piston with the second gear connected to the cylinder and the cylinder coupled to the spring so that release of the spring causes the cylinder to move toward the piston and to thereby generate pressurized air that ejects the object.

In a particular embodiment, the game includes a base, a manual actuator such as a plunger mounted on the base, an animated character mounted on the base and animated by depressing the plunger, and a random integer generator such as a spinner. The animated character includes an ejector that includes a container, a piston coupled to the container, a movable cylinder having a rack gear positioned on the side thereof, and a spring that is compressed or decompressed by movement of the cylinder, with decompression of the spring causing the cylinder to move toward the piston and generate pressurized air in the container. A ball is positioned in the container of the ejector so that pressurized air in the container, when present, causes the ball to be ejected from the container. The character also includes a gearing system coupled between the plunger and the rack gear of the cylinder so that depressing the plunger causes the cylinder to move and thereby compress the spring. The gearing system includes a pinion gear that meshes with the rack gear and causes the cylinder to compress the spring when the plunger is depressed. The pinion gear has a toothless portion that, when exposed to the rack gear, allows the rack gear to move freely and thereby allows the spring to decompress. The gearing system functions as a mechanical counter in that a sufficient number of actuations of the manual actuator will cause the toothless portion of the pinion gear to be exposed to the rack gear so that the ball is ejected. The character may also include moving arms that change position when the plunger is depressed.

Other features, objects, and advantages of the invention will become apparent from the following detailed description when read in connection with the accompanying drawings, in which.

Figure 1:
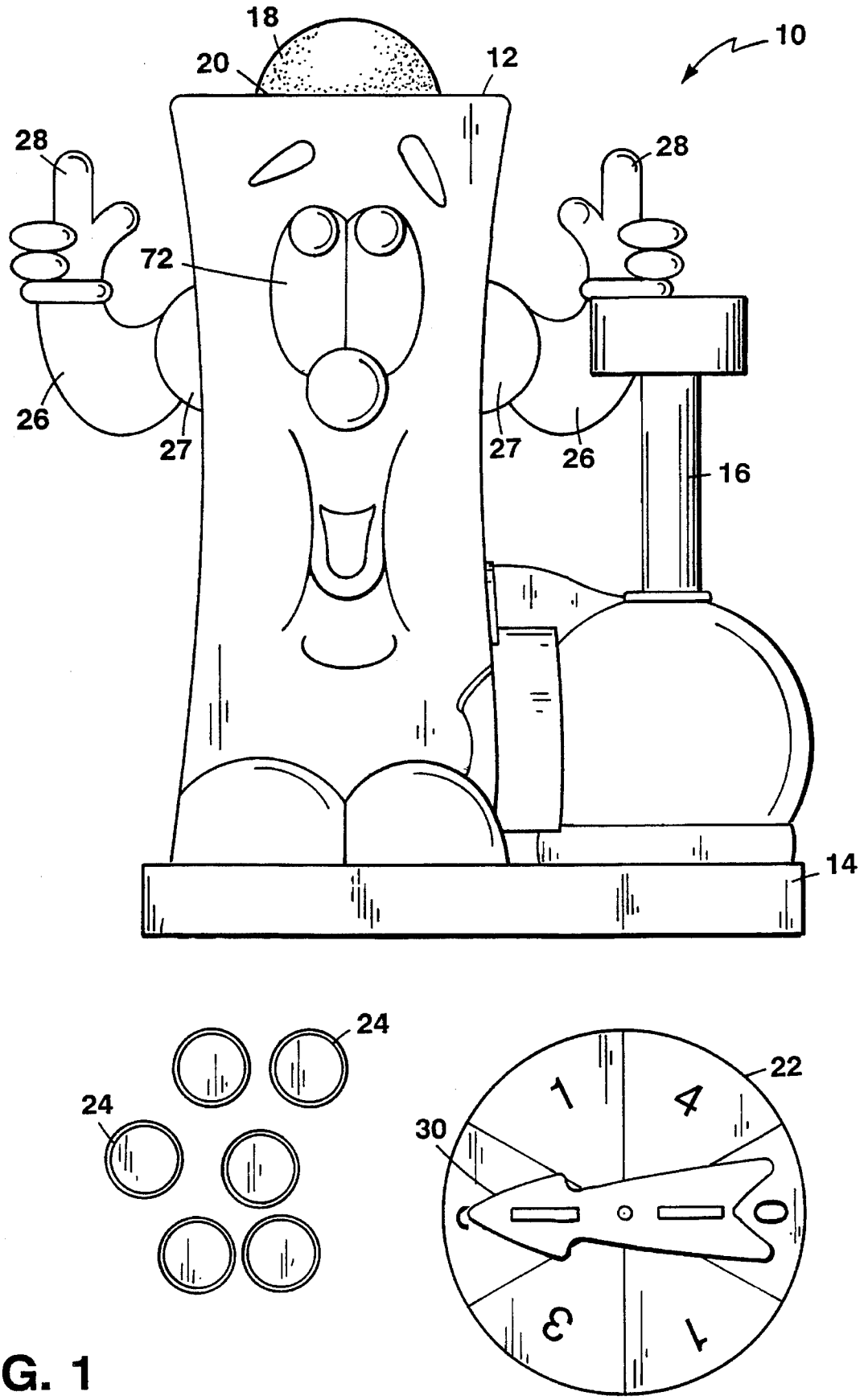
FIG. 1 is a front view of a game with an animated character.

Referring to FIG. 1, a game 10 includes an animated character 12 that is mounted on a common base 14 with a plunger 16. A dense foam ball 18, such as a Nerf® Blast-A-Ball® foam ball is positioned in an opening 20 in the top of animated character 12. Game 10 also includes a spinner 22 and tokens 24, the purpose of which will be described in detail below.

Figure 2:
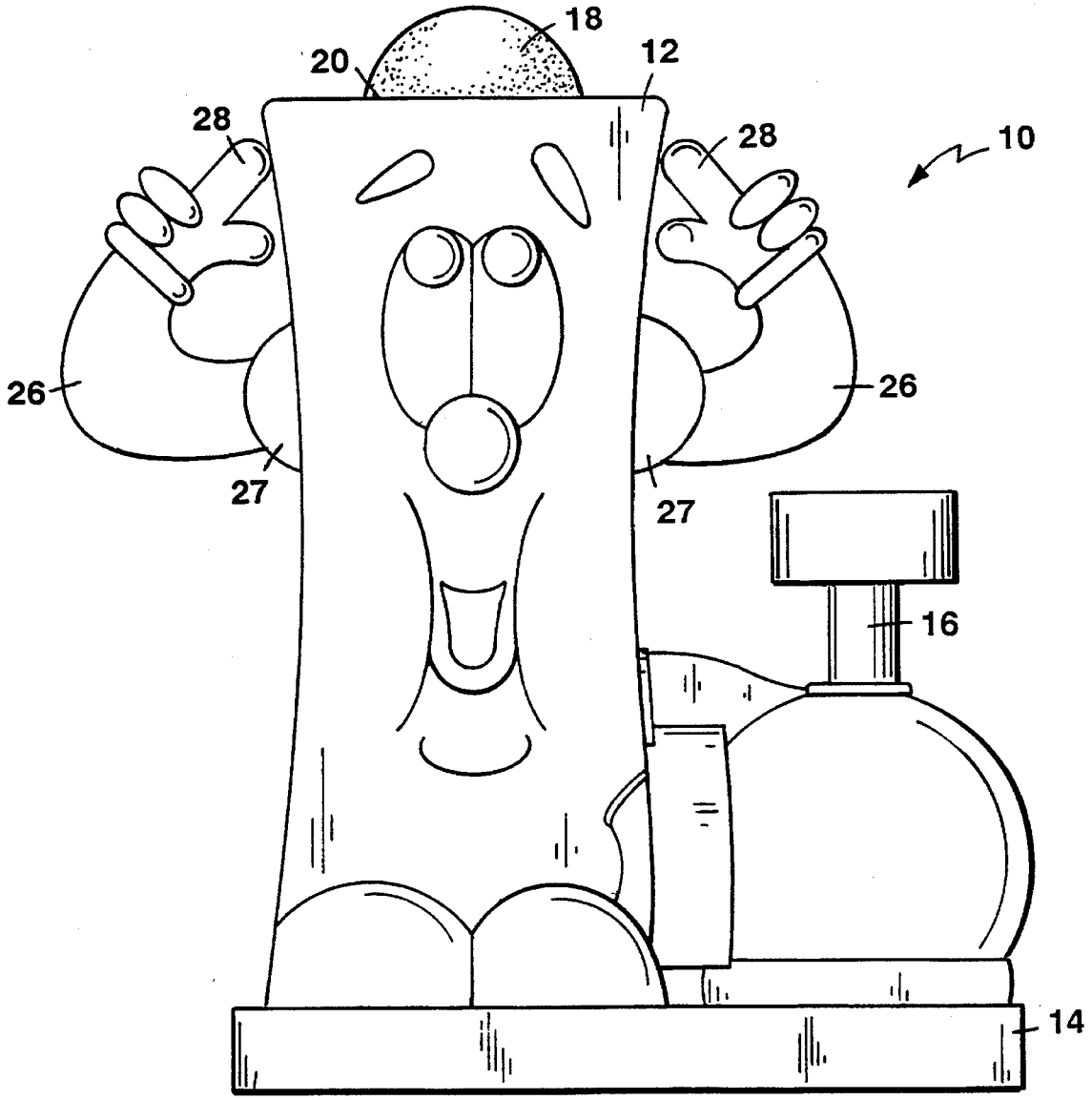
FIGS. 2–3 are front views of the animated character of the game of FIG. 1.

With reference also to FIG. 2, repeatedly depressing plunger 16 (which is shown in the depressed position in FIG. 2) causes the arms 26 of animated character 12 to rotate about axes 27 until fingers 28 of arms 26 are pressed against the side of animated character 12.

Figure 3:
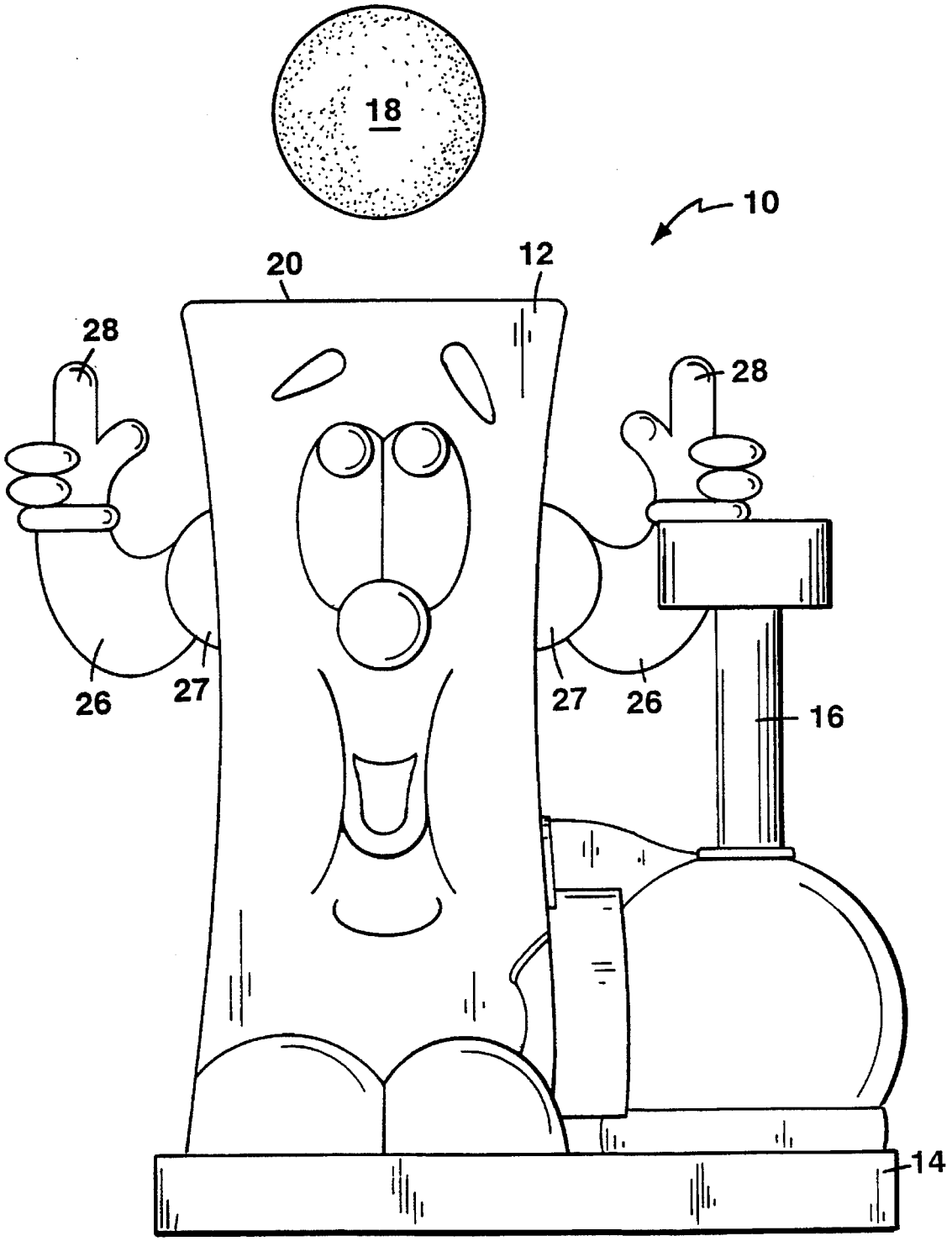

With reference also to FIG. 3, further repeated depression of plunger 16 eventually causes ball 18 to be launched from the opening 20 in the top of animated character 12. Simultaneously with ball 18 being launched, animated character 12 emits a loud sound, and arms 26 are released so that fingers 28 are no longer pressed against animated character 12.

Referring again to FIG. 1, a person playing game 10 begins each turn by spinning spinner 22. The person then presses plunger 16 the number of times corresponding to the number indicated by spinner 22. For example, if the arrow 30 of spinner 22 points to the number "1", then the person depresses plunger 16 one time. If the person causes ball 18 to be launched from the top of animated character 12, then the person is awarded a token 24. Otherwise, the person's turn ends, and the next player spins spinner 22. The first player to obtain three tokens 24 wins the game.

Figure 4:
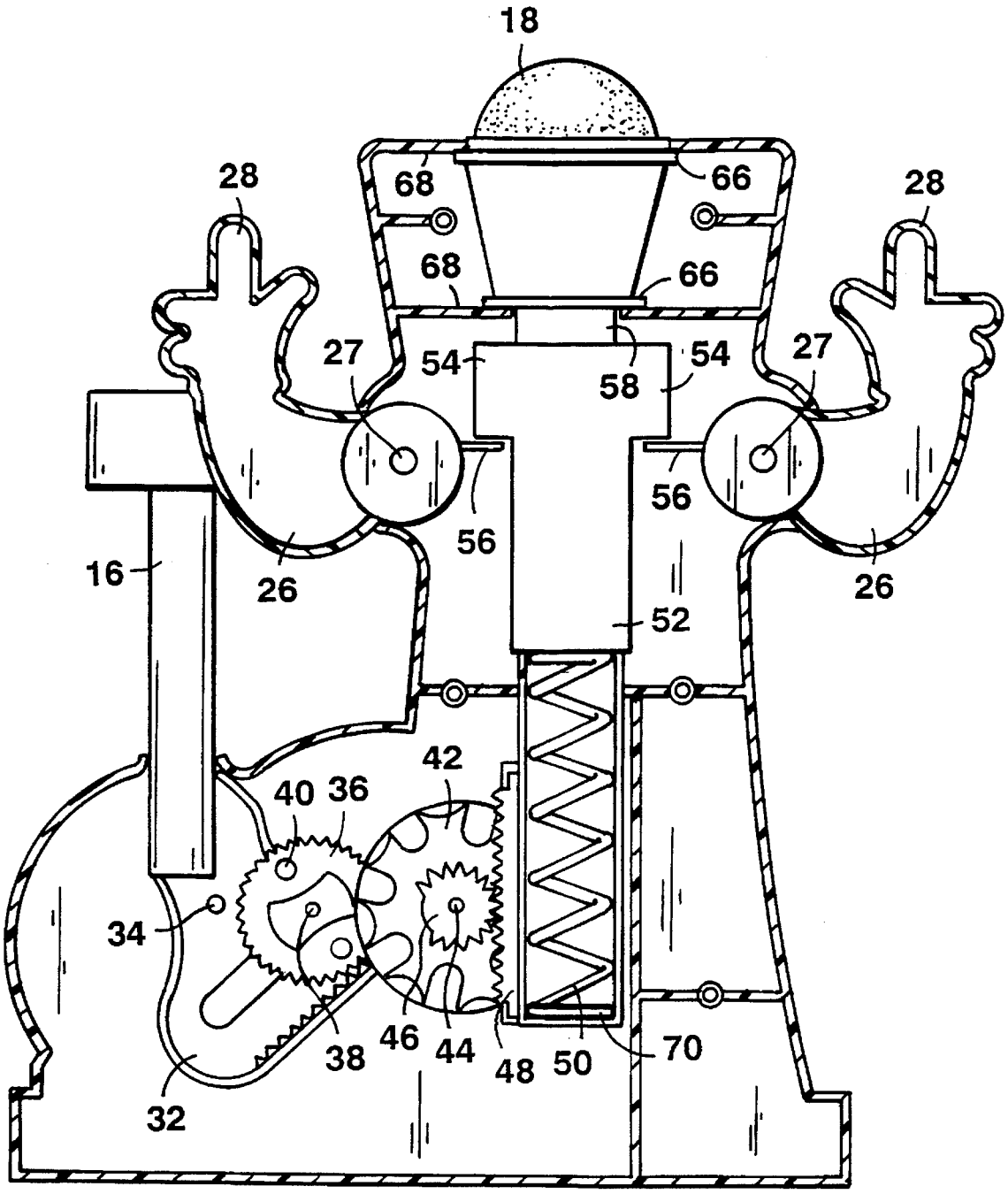
FIG. 4 is a rear view of the animated character of FIGS. 1–3 with a rear panel removed.

Referring to FIG. 4, depressing plunger 16 causes an internal sector gear 32 to rotate counterclockwise about axis 34, which, in turn, advances the first gear 36 of a geneva gear arrangement counterclockwise one sector about axis 38. Posts 40 on the first gear 36 of the geneva gear arrangement cause the second gear 42 of the geneva gear arrangement to rotate clockwise about axis 44. A pinion gear 46 mounted on second gear 42 rotates clockwise about axis 44 and draws rack gear 48 downwardly against coiled spring 50.

When plunger 16 is released, a spring (not shown) forces internal sector gear 32 to rotate clockwise about axis 34 and return to its original position. Clockwise rotation of gear 32 forces plunger 16 upward to its extended position. However, because gear 36 comprises two pieces: a bottom piece on which posts 40 are mounted and a top piece on which the teeth that mesh with gear 32 are mounted, and these pieces are coupled so that rotation of the bottom piece only causes rotation of the top piece when the bottom piece rotates in a counterclockwise direction, clockwise rotation of gear 32 has no effect on posts 40, gear 42, pinion gear 46 or rack gear 48.

Rack gear 48 is mounted on a cylinder assembly 52 that moves with rack gear 48. As cylinder assembly 52 and rack gear 48 move downward, extensions 54 on cylinder assembly 52 push down on springs 56 attached to arms 26, thereby causing arms 26 to rotate upward about axes 27. Once arms 26 reach the position (as illustrated in FIG. 2) in which fingers 28 are pressed against animated character 12, further downward movement of extensions 54 causes springs 56 to bend.

Pinion gear 46 includes a portion that lacks teeth. As plunger 16 is repeatedly depressed, pinion gear 46 advances so that the toothless portion is eventually aligned with rack gear 48. .When this alignment occurs, rack gear 48 is free to move vertically, and is driven upward by spring 50.

Figure 5:
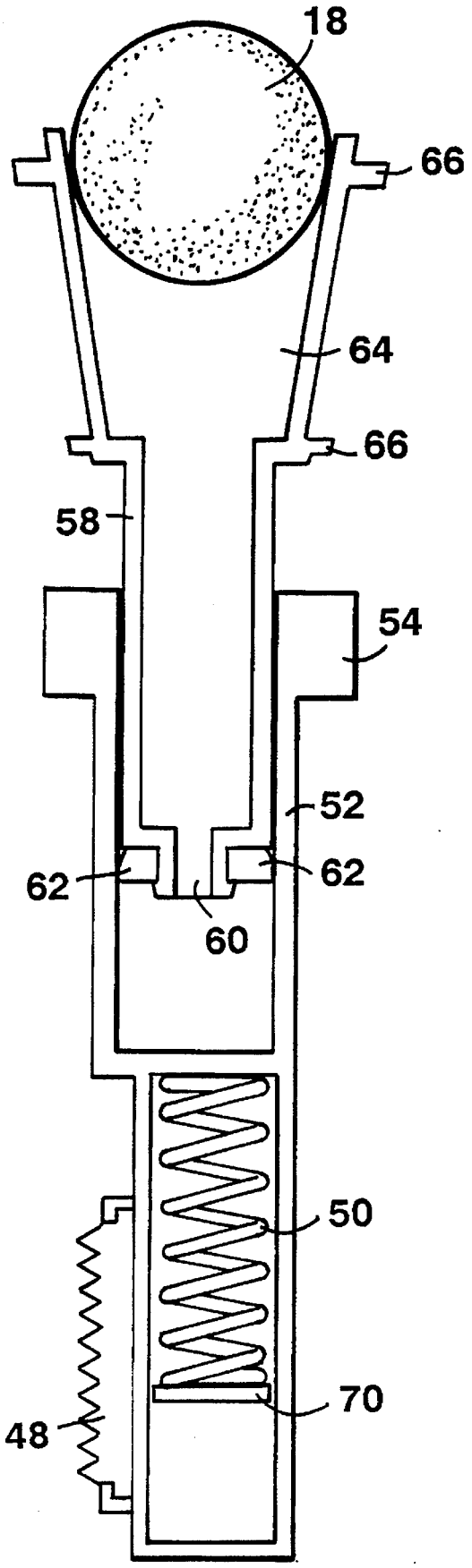
FIG. 5 is a cutaway view of a component of the animated character of FIGS. 1–4.

With reference also to FIG. 5, the resulting upward movement of cylinder assembly 52 forces air into piston 58 through opening 60. Flexible annular seal 62 prevents air from escaping around piston 58. Air driven into piston 58 creates a pressure increase in a cup assembly 64 that is connected to piston 58 and supports ball 18. This pressure buildup eventually launches ball 18 from the top of animated character 12. Collision between cylinder assembly 52 and piston 58 generates a loud sound from animated character 12.

Cup assembly 64 is secured in a fixed position on the inside of animated character 12 by interference between ridges 66 on cup assembly 64 and structure 68 within animated character 12. Similarly, structure 70 on the interior of animated character 12 prevents downward movement of the bottom of spring 50.

Willie Go Boom™, a game with an animated character available from Parker Brothers, is an example of a game according to the invention, and is hereby incorporated by reference.

Other embodiments are within the following claims. For example, in addition to moving arms and a launching ball, the eyes 72 of animated character 12 may be configured to bulge out as plunger 16 is depressed.

What is claimed is:

1. A game, comprising:

a manual actuator, an animated character coupled to and animated by actuation of the manual actuator and including:

an ejector operable to generate pressurized air, an object positioned in the ejector, a mechanical counter coupled to and incremented by actuation of the manual actuator, and a release mechanism coupled to and responsive to the mechanical counter to activate the ejector when the counter is incremented to a sufficient number and to thereby cause the ejector to generate pressurized air that ejects the object.

2. The game of claim 1, further comprising a random integer generator, wherein a player of the game generates a random integer with the random integer generator and actuates the manual actuator a number of times corresponding to the random integer.

3. The game of claim 2 wherein the random integer generator comprises a spinner.

4. A method of using the game of claim 2 comprising:

generating a random integer with the random integer generator, actuating the manual actuator a number of times corresponding to the random integer, if the object is ejected from the ejector, taking a token.

5. The game of claim 1 wherein the animated character further comprises moving arms the positions of which are changed by actuation of the manual actuator.

6. The game of claim 1 further comprising a base, wherein the animated character is mounted on the base and the manual actuator comprises a plunger that is also mounted on the base.

7. The game of claim 1 wherein the animated character further comprises a spring coupled to the ejector and wherein the release mechanism comprises a latch that normally maintains the spring in a compressed state, and wherein the latch releases the spring when the mechanical counter reaches a sufficient number.

8. The game of claim 7 wherein the ejector comprises a cylinder and piston arrangement, and wherein release of the spring causes the cylinder and the piston to interact so as to generate the pressurized air that ejects the object.

9. The game of claim 7 wherein the mechanical counter comprises a gearing system coupled between the manual actuator and the ejector.

10. The game of claim 9 wherein the gearing system is coupled to the ejector so that the gearing system compresses the spring when the manual actuator is actuated.

11. The game of claim 10 wherein the animated character further comprises moving arms the positions of which are changed by actuation of the manual actuator.

12. The game of claim 1 wherein the object comprises a foam ball.

13. A game, comprising:

a manual actuator, an animated character coupled to and animated by actuation of the manual actuator and including:

an ejector, an object positioned in the ejector, a mechanical counter coupled to and incremented by actuation of the manual actuator, and a release mechanism coupled to and responsive to the mechanical counter to activate the ejector and thereby cause the ejector to eject the object when the counter is incremented to a sufficient number, wherein:

the animated character further comprises a spring coupled to the ejector, the release mechanism comprises a latch that normally maintains the spring in a compressed state, the latch releases the spring when the mechanical counter reaches a sufficient number, the mechanical counter comprises a gearing system coupled between the manual actuator and the ejector, and wherein the latch comprises a first gear that is coupled to the gearing system and interacts with a second gear attached to the ejector to maintain the spring in a compressed state, the first gear having a toothless portion that releases the second gear and thereby releases the spring when the toothless portion is exposed to the second gear, and wherein the sufficient number of actuations is the number of actuations necessary to expose the toothless portion to the second gear.

14. The game of claim 13 wherein the first gear is a pinion gear and the second gear is a rack gear.

15. The game of claim 14 wherein:

the ejector comprises a movable cylinder and a fixed piston, the second gear is connected to the cylinder, and the cylinder is coupled to the spring so that release of the spring causes the cylinder to move toward the piston and to thereby generate pressurized air that ejects the object.

16. The game of claim 14 constructed and arranged so that interaction between the first and second gears compresses the spring when the manual actuator is actuated.

17. A game, comprising:

a base;

a manual actuator mounted on the base; and an animated character mounted on the base coupled to the manual actuator and animated by actuation of the manual actuator, the animated character including:

an ejector that includes a container, a piston coupled to the container, a movable cylinder having a rack gear positioned on the side thereof, and a spring that is compressed or decompressed by movement of the cylinder, wherein decompression of the spring causes the cylinder to move toward the piston and generate pressurized air in the container, a ball positioned in the container of the ejector so that pressurized air in the container, when present, causes the ball to be ejected from the container, and a gearing system coupled between the manual actuator and the rack gear of the cylinder so that actuation of the manual actuator causes the cylinder to move and thereby compress the spring, the gearing system including a pinion gear that meshes with the rack gear and causes the cylinder to compress the spring when the manual actuator is actuated, the pinion gear having a toothless portion that, when exposed to the rack gear, allows the rack gear to move freely and thereby allows the spring to decompress, wherein the gearing system functions as a mechanical counter in that a sufficient number of actuations of the manual actuator will cause the toothless portion of the pinion gear to be exposed to the rack gear so that the ball is ejected.

18. The game of claim 17 further comprising a spinner, wherein a player of the game generates a random integer with the spinner and actuates the manual actuator a number of times corresponding to the random integer.

19. The game of claim 17 wherein the animated character further comprises moving arms the positions of which are changed by actuation of the manual actuator.

20. The game of claim 17 wherein the manual actuator comprises a plunger.

* * * * *